US011406132B2

(12) United States Patent
Zuber et al.

(10) Patent No.: US 11,406,132 B2
(45) Date of Patent: Aug. 9, 2022

(54) ELECTRICALLY HEATED SMOKING SYSTEM WITH INTERNAL OR EXTERNAL HEATER

(71) Applicant: PHILIP MORRIS USA INC., Richmond, VA (US)

(72) Inventors: Gerard Zuber, Villars-sur-Glane (CH); Olivier Greim, Villars-Burquin (CH); Julien Plojoux, Geneva (CH); Dani Ruscio, Cressier (CH)

(73) Assignee: PHILIP MORRIS USA INC., Richmond, VA (US)

( * ) Notice: Subject to any disclaimer, the term of this patent is extended or adjusted under 35 U.S.C. 154(b) by 1117 days.

(21) Appl. No.: 15/057,738

(22) Filed: Mar. 1, 2016

(65) Prior Publication Data

US 2016/0174613 A1 Jun. 23, 2016

Related U.S. Application Data

(63) Continuation of application No. 14/738,184, filed on Jun. 12, 2015, now Pat. No. 11,272,738, which is a (Continued)

(30) Foreign Application Priority Data

Nov. 27, 2009 (EP) ..... 09252687

(51) Int. Cl.
*A24F 40/46* (2020.01)
*A24F 40/10* (2020.01)
*A24F 40/20* (2020.01)

(52) U.S. Cl.
CPC ..... *A24F 40/46* (2020.01); *A24F 40/10* (2020.01); *A24F 40/20* (2020.01)

(58) Field of Classification Search
None
See application file for complete search history.

(56) References Cited

U.S. PATENT DOCUMENTS 1,771,366 A 7/1930 Wyss et al.
1,968,509 A 7/1934 Tiffany
(Continued)

FOREIGN PATENT DOCUMENTS

AU 2010324131 B2 5/2016
CA 1202378 A1 3/1986
(Continued)

OTHER PUBLICATIONS

"Excerpt from 'NASA Tech Briefs'," Jul./Aug. 1988, p. 31.
(Continued)

*Primary Examiner* — Phu H Nguyen
(74) *Attorney, Agent, or Firm* — Harness, Dickey & Pierce, P.L.C.

(57) ABSTRACT

An electrically heated smoking system for receiving an aerosol forming substrate includes a heater for heating the substrate to form the aerosol. The heater includes a heating element. The electrically heated smoking system and the heating element are arranged such that, when the aerosol forming substrate is received in the electrically heated smoking system, the heating element extends a distance only partially along the length of the aerosol forming-substrate, and the heating element is positioned towards the downstream end of the aerosol forming substrate.

10 Claims, 3 Drawing Sheets

Related U.S. Application Data continuation of application No. 12/954,701, filed on Nov. 26, 2010, now Pat. No. 9,084,440.

(56) References Cited

U.S. PATENT DOCUMENTS 2,057,353 A 10/1936 Whittlemore, Jr.
2,104,266 A 1/1938 McCormick
2,406,275 A 8/1946 Wejnarth
2,442,004 A 5/1948 Hayward-Butt
2,971,039 A 2/1961 Western
2,974,669 A 3/1961 Ellis
3,200,819 A 8/1965 Gilbert
3,255,760 A 6/1966 Selker
3,258,015 A 6/1966 Ellis et al.
3,280,819 A 10/1966 Weeks
3,363,633 A 1/1968 Weber
3,402,723 A 9/1968 Hu
3,443,049 A 5/1969 Hoagland
3,482,580 A 12/1969 Hollabaugh
3,608,560 A 9/1971 Briskin et al.
3,738,374 A 6/1973 Bennett
3,744,496 A 7/1973 McCarty et al.
3,804,100 A 4/1974 Fariello
3,875,476 A 4/1975 Crandall et al.
3,889,690 A 6/1975 Guarnieri
3,895,219 A 7/1975 Richerson et al.
3,976,529 A 8/1976 Weichselbaum
4,016,061 A 4/1977 Wasa et al.
4,068,672 A 1/1978 Guerra
4,077,784 A 3/1978 Vayrynen
4,098,725 A 7/1978 Yamamoto et al.
4,103,144 A 7/1978 Pizzarello et al.
4,110,260 A 8/1978 Yamamoto et al.
4,131,119 A 12/1978 Blasutti
4,141,369 A 2/1979 Burruss
4,164,230 A 8/1979 Pearlman
4,193,411 A 3/1980 Faris et al.
4,215,708 A 8/1980 Bron
4,219,032 A 8/1980 Tabatznik et al.
4,246,913 A 1/1981 Ogden et al.
4,256,945 A 3/1981 Carter et al.
4,259,970 A 4/1981 Green, Jr.
4,303,083 A 12/1981 Burruss, Jr.
4,319,591 A 3/1982 Keith et al.
4,327,186 A 4/1982 Murata et al.
4,355,222 A 10/1982 Geithman et al.
4,393,884 A 7/1983 Jacobs
4,407,971 A 10/1983 Komatsu et al.
4,416,840 A 11/1983 Lee et al.
4,431,903 A 2/1984 Riccio
4,436,100 A 3/1984 Green, Jr.
4,449,039 A 5/1984 Fukazawa et al.
4,463,247 A 7/1984 Lawrence et al.
4,467,165 A 8/1984 Kiuchi et al.
4,475,029 A 10/1984 Yoshida et al.
4,488,335 A 12/1984 Fox et al.
4,503,319 A 3/1985 Moritoki et al.
4,505,282 A 3/1985 Cogbill et al.
4,521,659 A 6/1985 Buckley et al.
4,528,121 A 7/1985 Matsushita et al.
4,549,905 A 10/1985 Yamaguchi et al.
4,555,358 A 11/1985 Matsushita et al.
4,562,337 A 12/1985 Lawrence
4,570,646 A 2/1986 Herron
4,572,216 A 2/1986 Josuttis et al.
4,580,583 A 4/1986 Green, Jr.
4,621,649 A 11/1986 Osterrath
4,623,401 A 11/1986 Derbyshire et al.
4,634,837 A 1/1987 Ito et al.
4,637,407 A 1/1987 Bonanno
4,659,912 A 4/1987 Derbyshire
4,714,082 A 12/1987 Banerjee et al.
4,735,217 A 4/1988 Gerth et al.
4,765,859 A 8/1988 Heath et al.
4,771,796 A 9/1988 Myer
4,776,353 A 10/1988 Lilja et al.
4,789,767 A 12/1988 Doljack
4,837,421 A 6/1989 Luthy
4,846,199 A 7/1989 Rose
4,848,376 A 7/1989 Lilja et al.
4,874,924 A 10/1989 Yamamoto et al.
4,877,989 A 10/1989 Drews et al.
4,922,901 A 5/1990 Brooks et al.
4,945,931 A 8/1990 Gori
4,947,874 A 8/1990 Brooks et al.
4,947,875 A 8/1990 Brooks et al.
4,966,171 A 10/1990 Serrano et al.
4,981,522 A 1/1991 Nichols et al.
4,991,606 A 2/1991 Serrano et al.
5,016,656 A 5/1991 McMurtrie
5,040,551 A 8/1991 Schlatter et al.
5,040,552 A 8/1991 Schleich et al.
5,042,510 A 8/1991 Curtiss et al.
5,045,237 A 9/1991 Washburn
5,060,671 A 10/1991 Counts et al.
5,075,529 A 12/1991 Kudo
5,076,296 A 12/1991 Nystrom et al.
5,080,115 A 1/1992 Templeton
5,085,804 A 2/1992 Washburn
5,093,894 A * 3/1992 Deevi ..... A24F 47/008 392/390
5,095,921 A 3/1992 Losee et al.
5,101,086 A 3/1992 Dion et al.
5,139,594 A 8/1992 Rabin
5,144,962 A 9/1992 Counts et al.
5,157,242 A 10/1992 Hetherington et al.
5,159,940 A 11/1992 Hayward et al.
5,179,966 A 1/1993 Losee et al.
5,188,130 A 2/1993 Hajaligol et al.
5,224,498 A 7/1993 Deevi et al.
5,228,460 A 7/1993 Sprinkel et al.
5,235,157 A 8/1993 Blackburn
5,236,108 A 8/1993 House
5,249,586 A 10/1993 Morgan et al.
5,261,424 A 11/1993 Sprinkel, Jr.
5,268,553 A 12/1993 Shimoji
5,269,327 A 12/1993 Counts et al.
5,274,214 A 12/1993 Blackburn
5,285,050 A 2/1994 Blackburn
5,322,075 A 6/1994 Deevi et al.
5,353,813 A 10/1994 Deevi et al.
5,369,723 A 11/1994 Counts et al.
5,372,148 A 12/1994 McCafferty et al.
5,388,574 A 2/1995 Ingebrethsen
5,388,594 A * 2/1995 Counts ..... A24F 47/008 128/202.21
5,396,911 A 3/1995 Casey, III et al.
5,408,574 A 4/1995 Deevi et al.
5,469,871 A 11/1995 Barnes et al.
5,479,948 A 1/1996 Counts et al.
5,498,855 A 3/1996 Deevi et al.
5,499,636 A 3/1996 Baggett, Jr. et al.
5,505,214 A 4/1996 Collins et al.
5,514,630 A 5/1996 Willkens et al.
5,530,225 A 6/1996 Hajaligol
5,591,368 A 1/1997 Fleischhauer et al.
5,613,504 A 3/1997 Collins et al.
5,613,505 A 3/1997 Campbell et al.
5,665,262 A 9/1997 Hajaligol et al.
5,666,977 A 9/1997 Higgins et al.
5,666,978 A 9/1997 Counts et al.
5,708,258 A 1/1998 Counts et al.
5,750,964 A 5/1998 Counts et al.
5,819,751 A 10/1998 Barnes et al.
5,819,756 A 10/1998 Mielordt
5,878,752 A 3/1999 Adams et al.
5,915,387 A 6/1999 Baggett, Jr. et al.
5,934,289 A 8/1999 Watkins et al.
6,040,560 A 3/2000 Fleischhauer et al.
6,053,176 A 4/2000 Adams et al.
6,125,853 A 10/2000 Susa et al.
6,155,268 A 12/2000 Takeuchi
6,196,218 B1 3/2001 Voges
6,446,426 B1 9/2002 Sweeney et al.

(56) References Cited

U.S. PATENT DOCUMENTS

| | | | |
|---|---|---|---|
| 6,598,607 | B2 | 7/2003 | Adiga et al. |
| 6,615,840 | B1 | 9/2003 | Fournier et al. |
| 6,688,313 | B2 | 2/2004 | Wrenn et al. |
| 6,772,756 | B2 | 8/2004 | Shayan |
| 6,803,545 | B2 | 10/2004 | Blake et al. |
| 6,810,883 | B2 | 11/2004 | Felter et al. |
| 6,854,470 | B1 | 2/2005 | Pu |
| 7,117,867 | B2 | 10/2006 | Cox et al. |
| 7,131,599 | B2 | 11/2006 | Katase |
| 7,293,565 | B2 | 11/2007 | Griffin et al. |
| 7,458,374 | B2 | 12/2008 | Hale et al. |
| 7,690,385 | B2 | 4/2010 | Moffitt |
| 7,726,320 | B2 | 6/2010 | Robinson et al. |
| 7,832,410 | B2 | 11/2010 | Hon |
| 7,845,359 | B2 | 12/2010 | Montaser |
| 7,997,280 | B2 | 8/2011 | Rosenthal |
| 8,079,371 | B2 | 12/2011 | Robinson et al. |
| 8,205,622 | B2 | 6/2012 | Pan |
| 9,084,440 | B2 | 7/2015 | Zuber et al. |
| 2002/0079309 | A1 | 6/2002 | Cox et al. |
| 2002/0119873 | A1 | 8/2002 | Heitmann |
| 2004/0200488 | A1 | 10/2004 | Felter et al. |
| 2005/0016550 | A1 | 1/2005 | Katase |
| 2006/0112963 | A1 | 6/2006 | Scott et al. |
| 2006/0118128 | A1 | 6/2006 | Hoffmann et al. |
| 2006/0196518 | A1 | 9/2006 | Hon |
| 2007/0074734 | A1 | 4/2007 | Braunshteyn et al. |
| 2007/0102013 | A1* | 5/2007 | Adams ..... A24F 47/008 131/273 |
| 2007/0267033 | A1 | 11/2007 | Mishra et al. |
| 2008/0230052 | A1 | 9/2008 | Montaser |
| 2008/0276947 | A1 | 11/2008 | Martzel |
| 2009/0126745 | A1 | 5/2009 | Hon |
| 2009/0151717 | A1 | 6/2009 | Bowen et al. |
| 2009/0188490 | A1 | 7/2009 | Han |
| 2009/0230117 | A1 | 9/2009 | Fernando et al. |
| 2009/0272379 | A1 | 11/2009 | Thorens et al. |
| 2009/0320863 | A1 | 12/2009 | Fernando et al. |
| 2010/0163063 | A1 | 7/2010 | Fernando et al. |
| 2010/0307518 | A1 | 12/2010 | Wang |
| 2010/0313901 | A1 | 12/2010 | Fernando et al. |
| 2011/0094523 | A1 | 4/2011 | Thorens et al. |
| 2011/0120482 | A1 | 5/2011 | Brenneise |
| 2011/0147486 | A1 | 6/2011 | Greim et al. |
| 2011/0155151 | A1 | 6/2011 | Newman et al. |
| 2011/0155153 | A1 | 6/2011 | Thorens et al. |
| 2011/0155718 | A1 | 6/2011 | Greim et al. |
| 2011/0209717 | A1 | 9/2011 | Han |

FOREIGN PATENT DOCUMENTS

| | | | |
|---|---|---|---|
| CN | 87104459 | A | 2/1988 |
| CN | 1190335 | A | 8/1998 |
| CN | 1113620 | | 7/2003 |
| DE | 3640917 | A1 | 8/1988 |
| DE | 3 711 234 | A1 | 10/1988 |
| DE | 3735704 | A1 | 5/1989 |
| DE | 19854005 | A1 | 5/2000 |
| DE | 19854009 | A1 | 5/2000 |
| EP | 0 239 802 | A2 | 10/1987 |
| EP | 0277519 | A2 | 8/1988 |
| EP | 0295122 | A2 | 12/1988 |
| EP | 0358 002 | A2 | 3/1990 |
| EP | 0430559 | A2 | 6/1991 |
| EP | 0438862 | A2 | 7/1991 |
| EP | 0503767 | A1 | 9/1992 |
| EP | 1535524 | A1 | 6/2005 |
| EP | 2110033 | A1 | 10/2009 |
| EP | 2113178 | A1 | 11/2009 |
| EP | 2327318 | A1 | 6/2011 |
| GB | 2148676 | A | 5/1985 |
| JP | 03-192677 | | 8/1991 |
| JP | 3192677 | B2 | 7/2001 |
| JP | 2006320286 | A | 11/2006 |
| JP | 3996188 | B2 | 10/2007 |
| JP | 2009509523 | A | 3/2009 |
| KR | 19990081973 | A | 11/1999 |
| KR | 10-0385395 | | 5/2003 |
| KR | 10-0393327 | B1 | 10/2003 |
| KR | 100636287 | B1 | 10/2006 |
| KR | 100831535 | B1 | 5/2008 |
| KR | 20120104533 | A | 9/2012 |
| KR | 20180127542 | A | 11/2018 |
| KR | 10-1937075 | | 1/2019 |
| WO | WO-86/02528 | A1 | 5/1986 |
| WO | WO-9406314 | A1 | 3/1994 |
| WO | WO-95/02970 | A1 | 2/1995 |
| WO | WO-95/27411 | A1 | 10/1995 |
| WO | WO-9527412 | A1 | 10/1995 |
| WO | WO-96/32854 | A2 | 10/1996 |
| WO | WO-1998/023171 | | 6/1998 |
| WO | WO-9823171 | A1 | 6/1998 |
| WO | WO-00/28842 | A1 | 5/2000 |
| WO | WO-00/28843 | A1 | 5/2000 |
| WO | WO-2004/043175 | A1 | 5/2004 |
| WO | WO-2004/080216 | A1 | 9/2004 |
| WO | WO-2004/095955 | A1 | 11/2004 |
| WO | WO-2005/099494 | A1 | 10/2005 |
| WO | WO-2007042941 | A2 | 4/2007 |
| WO | WO-2007/066167 | A1 | 6/2007 |
| WO | WO-2007/066374 | A1 | 6/2007 |
| WO | WO-2007/078273 | A1 | 7/2007 |
| WO | WO-2007/131449 | A1 | 11/2007 |
| WO | WO-2007/131450 | A1 | 11/2007 |
| WO | WO-2008/015441 | A1 | 2/2008 |
| WO | WO-2008/055423 | A1 | 5/2008 |
| WO | WO-2008/121610 | A1 | 10/2008 |
| WO | WO-2009/022232 | A2 | 2/2009 |
| WO | WO-2010/091593 | A1 | 8/2010 |
| WO | WO-2010/145468 | A1 | 12/2010 |
| WO | WO-2011/063970 | A1 | 6/2011 |

OTHER PUBLICATIONS

"Joing of Ceramics" by R.E. Loehman et al., published in Ceramic Bulletin, 67(d); 375-380 (1988).

Oxidation Behavior of Silver- and Copper-Based Brazing Filler Metals for Silicon Nitride/Metal Joints by R.R. Kappor et al., published in J. Am. Ceram. Soc., 72(3):448-454 (1989).

"Brazing Ceramic Oxides to Metals at Low Temperatures" by J.P Hammond et al., published in Welding Research Supplement, 227-232-s, (1988).

"Brazing of Titanium-Vapor-Coated Silicon Nitride" by M. L. Santella, published in Advanced Ceramic Materials, 3(5):457-465 (1988).

"Microstructure of Alumina Brazed with a Silver-Cooper-Titanium Alloy" by M.L. Santella et al., published in J. Am. Ceram. Soc., 73(6):1785-1787 (1990).

John A. Dean, Lange's handbook of Chemistry, 12th Edition, 1978 pp. 4-16, 4-123.

Fen et al., "Cyclic oxidation of Haynes 230 alloy", Chapman & Hall, pp. 1514-1520 (1992).

Reinshagen and sikka, "Thermal Spraying of Selected Aluminides", Proceedings of the Fourth National Thermal Spray Conference, Pitsburgh, PA USA, pp. 307-313 (May 4-10, 1991).

Kutner, "Thermal spray by design", Reprint from Advanced Materials & Processes Incorporating Metal Progress, (Oct. 1988).

Characterizing Thermal Spray Coatings, Article based on presentation made at the Fourth National Thermal Spray Conference, (May 4-10, 1991) and appearing in Advanced Materials and Processes, May 1992, pp. 23-27.

Howes, Jr., "Computerized Plasma Control for Applying Medical-Quality Coatings", Industrial Heating, pp. 22-25, Aug. 1993.

V. Sikka, "Processing of Aluminides", Intermetallic Metallurgy and Processing INtermetallic Compounds, ed Stoloff et al., Van Mestrand Reinhold, N.Y., 1994.

Brezovich, "Temperature Distributions in Tumor Models Heated by Self-Regulating Nickel-Copper Alloy Thermoseeds," Mar./Apr. 1984, pp. 145-152.

(56) References Cited

OTHER PUBLICATIONS

Duarte. "A Design Procedure for a Self Oscillating Hybrid INverter," 1991, pp. 350-355.
Gorbacheb. "Compensation of Varying Load in a Thyistor," v. 56, No. 3, pp. 27-28.
Matthes, "Thyristorised Conerters for Inductive Heatingfor Hot Forging," 1975, pp. 80-86.
Stauffer, "Observations on the Use of Ferromagnetic Implants for Inducing Hypothermia" 1984, pp. 76-90.
Katagiri, "Rapid Reinforcement for Fusion Mass Spliced Fibers using Low-Power," Jun. 1, 1985, pp. 1708-1712.
International Search Report dated May 7, 2010 for European Patent Application No. 09252687.
Australian Office Action dated Nov. 18, 2015.
Australian Notice of Allowance dated Apr. 27, 2016.
Canadian Office Action dated Oct. 3, 2016.
Canadian Office Action dated Jul. 10, 2018.
Chinese Office Action and English translation thereof dated Jan. 6, 2014.
Chinese Office Action and English translation thereof dated Sep. 2, 2014.
Chinese Office Action and English translation thereof dated Feb. 17, 2015.
Chinese Office Action dated Sep. 2, 2015.
Chinese Office Action dated Jan. 6, 2016.
Colombia Office Action dated Jun. 25, 2013.
Eurasian Office Action dated May 29, 2014.
Eurasian Office Action dated Dec. 26, 2014.
Eurasian Notice of Allowance dated Oct. 15, 2015.
European Office Action dated May 7, 2010.
European Office Action dated Sep. 30, 2014.
European Notice of Allowance dated Jan. 4, 2018.
European Office Action dated Dec. 12, 2017.
European Office Action dated May 7, 2018.
Indonesian Office Action and English translation thereof dated Sep. 24, 2018.
Israeli Office Action dated Jan. 21, 2015.
Japanese Office Action and English translation thereof dated Dec. 5, 2014.
Japanese Notice of Allowance dated Sep. 2, 2015.
Korean Office Action and English translation thereof dated Apr. 10, 2017.
Korean Notice of Allowance dated Oct. 12, 2017.
Mexican Office Action and English translation thereof dated Jun. 30, 2014.
Mexican Office Action an English translation thereof dated Jan. 8, 2015.
Mexican Office Action dated Mar. 31, 2015.
Mexican Office Action dated Oct. 19, 2015.
Mexican Notice of Allowance dated Jun. 3, 2016.
New Zealand Office Action dated Mar. 15, 2013.
New Zealand Notice of Allowance dated Jun. 25, 2014.
International Search Report dated Mar. 10, 2011.
International Preliminary Report on Patentability dated Mav 30, 2012.
Philippines Office Action and English translation thereof dated Mar. 10, 2014.
Philippines Office Action and English translation thereof dated Apr. 8, 2016.
Singapore Office Action and English translation thereof dated Oct. 22, 2013.
Ukraine Notice of Allowance and English translation thereof dated Mar. 14, 2014.
Vietnam Office Action and English translation thereof dated Aug. 27, 2015.
U.S. Office Action for corresponding U.S. Appl. No. 14/738,184 dated Dec. 29, 2017.
Indian Office Action dated Nov. 20, 2018.
U.S. Office Action for corresponding U.S. Appl. No. 14/738,184 dated Jul. 9, 2019.
Korean Third Party Observation mailed May 21, 2019.
U.S. Office Action for corresponding U.S. Appl. No. 14/738,184 dated Dec. 14, 2018.
European Notice of Opposition mailed Jan. 10, 2019.
European Notice of Opposition for European Application No. 10793150.3 mailed Jan. 10, 2019.
Sole substantive communication from the application to the EPO during the Examination Procedure dated Jan. 13, 2015.
Korean Third Party Observations mailed Aug. 16, 2019.
Brazilian Office Action and English translation thereof dated Aug. 6, 2019.
Korean Office Action and English translation thereof dated May 21, 2019.
Korean Office Action and English translation thereof dated Mar. 20, 2020.
Korean Office Action and English translation thereof dated Jun. 2, 2020.
Korean Office Action dated Jul. 29, 2020.
Korean Notice of Allowance dated Aug. 18, 2020.
Canadian Office Action dated Jul. 13, 2020 issued in Canadian Application No. 3,031,261.
European Third Party Observations mailed Jun. 9, 2020.
Korean Ofice Action and English translation thereof dated May 21, 2020.
European Notice of Allowance dated Jun. 5, 2020.
U.S. Notice of Allowance for corresponding U.S. Appl. No. 14/738,184 dated Jun. 26, 2020.
European Notice of Opposition mailed Sep. 9, 2020.
Philip Morris USA, "2020256736/2020256810"—"Heater concept," http://www.pmdocs.com/#Search, Jun. 5, 1998.
Screenshot from Philip Morris USA Public Document Site showing details for "2020/256736/2020256810"—"Heater concept," Aug. 22, 2020.
Korean Office Action and English translation thereof dated Nov. 25, 2020.
Korean Notice of Allowance dated Dec. 18, 2020.
Korean Notice of Preliminary Rejection and English translation thereof dated Jan. 4, 2022.
Extended European Search Report dated Feb. 23, 2022.
Korean Office Action and English translation thereof dated Feb. 15, 2021.
Korean IPTAB Panel Decision and Partial English translation dated Nov. 30, 2021.
Korean Notice of Allowance dated Dec. 17, 2021.
Malaysian Substantive Examination Adverse Report dated Jul. 31, 2021.
Korean Third Party Observation dated Dec. 11, 2019.
Korean Third Party Observation dated Dec. 13, 2019.
Brazilian Notice of Allowance dated Dec. 17, 2019.
U.S. Office Action for corresponding U.S. Appl. No. 14/738,184 dated Mar. 18, 2021.
Korean Notice of Allowance dated Sep. 4, 2021.
Korean Office Action and English translation thereof dated Sep. 10, 2019.
European communication pursuant to Article 94(3) dated Nov. 25, 2019.
Extended European Search Report dated Oct. 26, 2020.
Canadian Notice of Allowance dated Feb. 11, 2021.
European Intention to Grant dated Sep. 9, 2021.
U.S. Notice of Allowance for corresponding U.S. Appl. No. 14/738,184 dated Oct. 13, 2021.
European Third Party Observations mailed Dec. 20, 2018.
Korean Notice of Preliminary Rejection and English translation thereof dated Dec. 26, 2018.
Extended European Search Report dated May 9, 2022.
Malaysian Notice of Allowance dated Apr. 12, 2022.

* cited by examiner

ELECTRICALLY HEATED SMOKING SYSTEM WITH INTERNAL OR EXTERNAL HEATER

CROSS-REFERENCE TO RELATED APPLICATIONS

This is a continuation of, and claims priority under 35 U.S.C. § 120 to, U.S. application Ser. No. 14/738,184, filed Jun. 12, 2015, which is a continuation application of U.S. application Ser. No. 12/954,701 filed Nov. 26, 2010 which corresponds and claims priority under 35 U.S.C. § 119 to European Application No. 09252687.0, filed Nov. 27, 2009, the entire content of each is hereby incorporated by reference.

BACKGROUND

EP-A-0 358 002 discloses a smoking system including a cigarette with a resistance heating element for heating tobacco material in the cigarette. The cigarette has an electrical connection plug for connection to a reusable, hand held controller. The hand held controller includes a battery and a current control circuit which controls the supply of power to the resistance heating element in the cigarette.

One problem of such a proposed smoking system is that tobacco smoke tends to condense on the internal walls of the system. This is undesirable because condensation build up on the internal walls of the system can lead to reduced performance.

Accordingly, it is advantageous to provide an electrically heated smoking system which, in use, substantially reduces or minimizes the occurrence of smoke or aerosol condensation on its internal walls.

SUMMARY OF SELECTED FEATURES

In a preferred embodiment, an electrically heated smoking system includes an aerosol forming substrate, and a heater for heating the substrate to form the aerosol. Preferably, the heater includes a first heating element. Also preferably, the electrically heated smoking system and the first heating element are arranged such that, when the aerosol forming substrate is received in the electrically heated smoking system, the first heating element extends a distance only partially along the length of the aerosol forming-substrate, and the first heating element is positioned towards the downstream end of the aerosol forming substrate.

In the preferred embodiment, the first heating element extends substantially fully around the circumference of the aerosol forming substrate. Preferably, the first heating element is arranged to be inserted into the aerosol forming substrate.

Also preferably, a downstream end of the first heating element is upstream of a downstream end of the aerosol forming substrate by a distance greater than or equal to about 1 mm. Moreover, an upstream end of the first heating element is downstream of an upstream end of the aerosol forming substrate by a distance ranging from about 2 mm to about 6 mm. In the preferred embodiment, the upstream end of the first heating element is downstream of the upstream end of the aerosol forming substrate by a distance of about 4 mm.

Preferably, the ratio of the distance that the first heating element extends along the aerosol forming substrate, to the length of the aerosol forming substrate, is ranges from about 0.35 to about 0.6. Also preferably, the ratio of the distance that the first heating element extends along the aerosol forming substrate to the length of the aerosol forming substrate is about 0.5.

In the preferred embodiment, the heater further includes a second heating element arranged, when the aerosol forming substrate is received in the electrically heated smoking system: to extend a distance only partially along the length of the aerosol forming substrate, and to be upstream of the first heating element. Moreover, the separation between the upstream end of the first heating element and the downstream end of the second heating element is equal to or greater than about 0.5 mm. Preferably, the upstream end of the second heating element is downstream of the upstream end of the aerosol forming substrate by a distance ranging from about 2 mm to about 4 mm. Also preferably, the upstream end of the second heating element is downstream of the upstream end of the aerosol forming substrate by a distance of about 3 mm. Moreover, the ratio of the distance that the first heating element and the second heating element together extend along the aerosol forming substrate, to the length of the aerosol forming substrate is between 0.5 and 0.8.

In the preferred embodiment, the aerosol forming substrate is a solid substrate. Preferably, aerosol forming substrate is a liquid substrate.

BRIEF DESCRIPTION OF THE DRAWINGS

The invention will be further described, by way of example only, with reference to the accompanying drawings wherein like reference numerals are applied to like elements and wherein.

DETAILED DESCRIPTION

Figure 1:
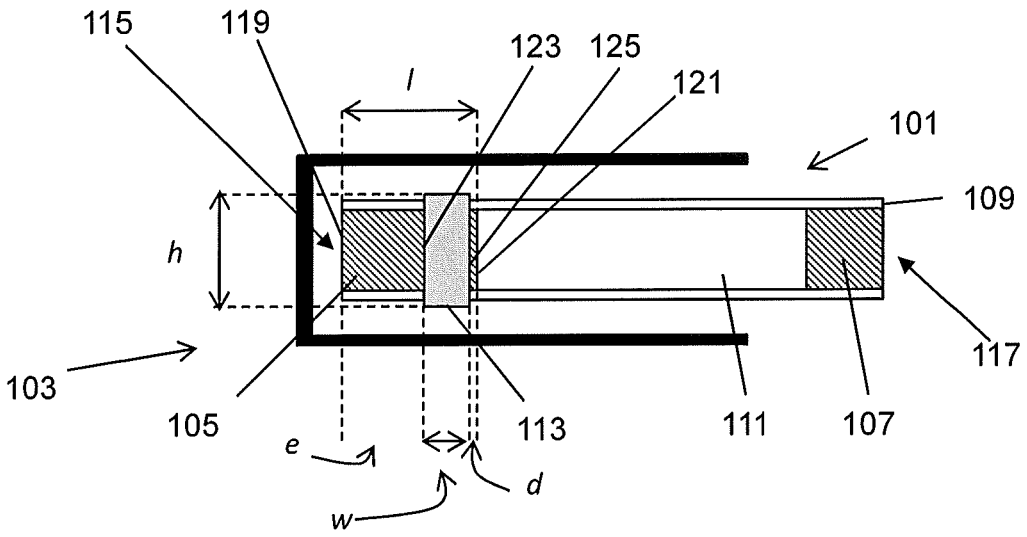
FIG. 1 is a schematic diagram showing a first embodiment of the electrically heated smoking system in smoking with a smoking article.

The present invention relates to an electrically heated smoking system including a heater for heating an aerosol forming substrate.

In a preferred embodiment, an electrically heated smoking system for receiving an aerosol forming substrate includes a heater for heating the substrate to form the aerosol. The heater includes a heating element. The electrically heated smoking system and the heating element are arranged such that, when the aerosol forming substrate is received in the electrically heated smoking system, the heating element extends a distance only partially along the length of the aerosol forming-substrate, and the heating element is positioned towards the downstream end of the aerosol forming substrate.

According to another embodiment, an electrically heated smoking system for receiving an aerosol forming substrate includes a heater for heating the substrate to form the aerosol. Preferably, the heater includes a heating element. Also preferably, the electrically heated smoking system and the heating element are arranged such that, when the aerosol forming substrate is received in the electrically heated smoking system, the heating element extends a distance only partially along the length of the aerosol forming-substrate.

According to yet another embodiment, an electrically heated smoking system for receiving an aerosol forming substrate includes a heater for heating the substrate to form the aerosol. The heater includes a heating element. Preferably, the electrically heated smoking system and the heating element are arranged such that, when the aerosol forming substrate is received in the electrically heated smoking system, the heating element is positioned towards the downstream end of the aerosol forming substrate.

Preferably, positioning the heating element such that it extends only partially along the aerosol forming substrate's length reduces the power required to heat the substrate and produce the aerosol.

Furthermore, positioning the heating element towards the downstream end of the aerosol forming substrate also substantially reduces or minimizes the occurrence of condensation of the aerosol on the internal walls of the smoking system. This is because the non-heated portion of the aerosol forming substrate (for example, a tobacco rod) located away from the heating element acts as a filtration zone, thereby minimizing the occurrence of aerosol leaving the upstream end of the aerosol forming substrate.

In addition, positioning the heating element towards the downstream end of the aerosol forming substrate shortens the zone contained between the downstream end of the heating element and the downstream end of the aerosol forming substrate. This leads to a significant reduction in the energy required to generate an aerosol for the smoker. This also leads to a reduction in the time to first puff, that is to say, the time between energizing the heating element and providing the aerosol to a smoker.

In the preferred embodiment, the heating element may be an external heating element. Preferably, the heating element extends fully or partially around the circumference of the aerosol forming substrate. In one embodiment, the heating element extends substantially fully around the circumference of the aerosol forming substrate.

Alternatively, the heating element may be an internal heating element. When the heating element is an internal heating element, preferably, the heating element is arranged to be inserted into the aerosol forming substrate. The internal heating element may be positioned at least partially within or inside the aerosol forming substrate.

Preferably, the aerosol forming substrate is substantially cylindrical in shape. Also preferably, the aerosol forming substrate may be substantially elongate. The aerosol forming substrate may also have a length and a circumference substantially perpendicular to the length. Moreover, the electrically heated smoking system includes an aerosol forming substrate in which the length of the aerosol forming substrate is substantially parallel to airflow direction in the electrically heated smoking system.

In the preferred embodiment, the electrical energy is supplied to the heating element (or, in embodiments where further heating elements are included, to one or more of the heating elements) until the heating element or elements reach a temperature ranging from about 250° C. to about 440° C. Any suitable temperature sensor and control circuitry may be used in order to control heating of the heating element or elements to reach the temperature ranging from about 250° C. to about 440 C. This is in contrast to conventional cigarettes in which the combustion of tobacco and cigarette wrapper may reach 800 C.

In the preferred embodiment, the upstream and downstream ends of the electrically heated smoking system are defined with respect to the airflow when the smoker takes a puff. Typically, incoming air enters the electrically heated smoking system at the upstream end, combines with the aerosol, and carries the aerosol in the airflow towards the smoker's mouth at the downstream end. Furthermore, as known to those skilled in the art, an aerosol is a suspension of solid particles or liquid droplets or both solid particles and liquid droplets in a gas, such as air.

Preferably, the substrate forms part of a separate smoking article and the smoker may puff directly on the smoking article. The smoking article may be substantially cylindrical in shape. Preferably, the smoking article may be substantially elongate. Also preferably, the smoking article may have a length and a circumference substantially perpendicular to the length. Moreover, the smoking article may have a total length ranging from about 30 mm to about 100 mm. The smoking article may have an external diameter ranging from about 5 mm to about 12 mm.

Additionally, the smoking article may include a filter plug, which may be located at the downstream end of the smoking article. Preferably, the filter plug may be a cellulose acetate filter plug. Also preferably, the filter plug is about 7 mm in length, but may have a length ranging from about 5 mm to about 10 mm.

Preferably, the smoking article is a cigarette. In the preferred embodiment, the smoking article has a total length of about 45 mm. It is also preferable for the smoking article to have an external diameter of about 7.2 mm. Preferably, the aerosol forming substrate includes tobacco. Further, the aerosol forming substrate may have a length of about 10 mm. However it is most preferable for the aerosol forming substrate to have a length of about 12 mm. Further, the diameter of the aerosol forming substrate may also range from about 5 mm to about 12 mm. Preferably, the smoking article may include an outer paper wrapper. Furthermore, the smoking article may include a separation between the aerosol forming substrate and the filter plug. In the preferred embodiment, the separation may be about 18 mm, but may be in the range of about 5 mm to about 25 mm.

In the preferred embodiment, the heating element being positioned towards the downstream end of the aerosol forming substrate may be defined as the separation between the downstream end of the heating element and the downstream end of the aerosol forming substrate, being less than the separation between the upstream end of the heating element and the upstream end of the aerosol forming substrate.

Preferably, the downstream end of the heating element is upstream of the downstream end of the aerosol forming substrate by a distance d (See FIG. 1) equal to, or greater than, about 1 mm. Having a distance d of greater than, or equal to about 1 mm (rather than having d=0), avoids the heater being immediately adjacent the non-aerosol forming part of the smoking article, such as the non-tobacco part of the cigarette (with the exception of the cigarette paper) downstream to the tobacco plug. This reduces heat dissipation through non-tobacco materials. Furthermore, this gap allows a reduction of mainstream smoke temperature.

Preferably, the upstream end of the heating element is downstream of the upstream end of the aerosol forming substrate by a distance e ranging from about 2 mm to about 6 mm. More preferably, the upstream end of the heating element is downstream of the upstream end of the aerosol forming substrate by a distance e of about 4 mm.

Preferably, the non-heated portion of the aerosol forming substrate located at the upstream end, that is, between the upstream end of the aerosol forming substrate and the upstream end of the heating element, provides an efficient filtration zone. This substantially reduces or minimizes the occurrence of aerosol leaving the upstream end of the aerosol forming substrate in the electrically heated smoking system. This also substantially reduces or minimizes the occurrence of condensation of aerosol inside the electrically heated smoking system, which substantially reduces or minimizes the number of cleaning operations required throughout the smoking system's lifetime. In addition, the non-heated upstream portion of the aerosol forming substrate acts as a slow-release aerosol reservoir which may be accessible by thermal conduction through the substrate throughout the smoking experience.

Preferably, the ratio of the distance w, that the heating element extends along the aerosol forming substrate, to the length l of the aerosol forming substrate, $$\frac{w}{l}$$

ranges from about 0.35 to about 0.6. Even more preferably, the ratio $$\frac{w}{l}$$

is about 0.5.

Preferably, the ratio of $$\frac{w}{l}$$

ranging from about 0.35 to about 0.6 has the advantage that it substantially increases or maximizes the volume of aerosol delivered to the smoker, while substantially reducing or minimizing the amount of aerosol leaving the upstream portion of the aerosol forming substrate. This substantially reduces or minimizes the occurrence of condensation of the aerosol in the smoking system. Further, this ratio also has the advantage that it substantially reduces or minimizes heat loss through non-tobacco materials. This means that the smoking system requires less energy.

More preferably, the ratio of the distance that the heating element extends along the aerosol forming substrate to the length of the aerosol forming substrate is about 0.5. A ratio of about 0.5 (for an aerosol forming substrate such as a tobacco plug of either 10 mm or 12 mm) offers the best balance in terms of aerosol deliveries, minimization of the occurrence of aerosol leaving the upstream end of the aerosol forming substrate and aerosol temperature.

In the preferred embodiment of the electrically heated smoking system, the heater further includes a second heating element arranged, when the aerosol forming substrate is received in the electrically heated smoking system: to extend a distance y only partially along the length l of the aerosol forming substrate; and to be upstream of the first heating element. The first heating element, the second heating element or both heating elements may extend substantially partially or fully around the circumference of the aerosol forming substrate.

In another embodiment, (see FIG. 2) the heater further includes a second heating element arranged, when the aerosol forming substrate is received in the electrically heated smoking system, to extend a distance y only partially along the length l of the aerosol forming substrate.

Providing a second heating element upstream of the first heating element allows different parts of the aerosol forming substrate to be heated at different times. This is also advantageous, since the aerosol forming substrate does not need to be reheated for example if the smoker wishes to stop and resume the smoking experience. In addition, providing two separate heating elements provides for more straightforward control of the temperature gradient along the aerosol forming substrate and hence control of the aerosol generation. Preferably, the heating elements are independently controllable.

In still another embodiment, additional heating elements may be provided between the first and second heating elements. For example, the heater may include three, four, five, six or more heating elements.

Preferably, the separation s between the first heating element and the second heating element is equal to or greater than about 0.5 mm. That is to say preferably, the separation s between the upstream end of the first heating element and the downstream end of the second heating element is equal to or greater than about 0.5 mm. However, any separation between the first and second heating elements may be used, provided the first and second heating elements are not in electrical contact with each other.

Preferably, the upstream end of the second heating element is downstream of the upstream end of the aerosol forming substrate by a distance g ranging from about 2 mm to about 4 mm. Even more preferably, the upstream end of the second heating element is downstream of the upstream end of the aerosol forming substrate by a distance g of about 3 mm.

Again, the non-heated portion of the aerosol forming substrate located at the upstream end, that is, between the upstream end of the aerosol forming substrate and the upstream end of the second heating element, provides an efficient filtration zone. This substantially reduces or minimizes the occurrence of aerosol escaping from the upstream end of the aerosol forming substrate in the electrically heated smoking system. This also substantially reduces or minimizes the occurrence of condensation of aerosol inside the electrically heated smoking system, which substantially reduces or minimizes the number of cleaning operations required throughout the electrically heated smoking system's lifetime. In addition, the non-heated upstream portion of the aerosol forming substrate acts as a slow-release aerosol reservoir which may be accessible by thermal conduction through the substrate throughout the smoking experience.

For embodiments which have two heating elements, the lengths of both the heating elements may be slightly reduced (compared to the length of the heating element in embodiments which only have one heating element) in order to keep a zone upstream of the second heating element which is cooler than the heated portion of the aerosol forming substrate, and a zone downstream of the first heating element which is cooler than the heated portion of the aerosol forming substrate. That is to say, for embodiments which only have a single heating element, the heating element may have a length of about 4 mm. Then, for embodiments which having two heating elements, the length of each heating element may be reduced to about 3 mm, for example. A decrease in length may be compensated by a higher electrically power.

Alternatively, the first heating element (downstream) may have substantially the same dimension as the heating element in the smoking system which only has a single heating element, but the second heating element (upstream) may be shorter in length than the first heating element. That is to say, the first heating element has a length which is greater than the length of the second heating element. For example, the first heating element may have a length of about 4 mm, while the second heating element may have a length of about 3 mm.

This means that substantially equal aerosol yields and time to first puff are provided by the first and second heating elements.

Preferably, the ratio of the distance (x+y) that the first heating element and the second heating element together extend along the aerosol forming substrate, to the length l of the aerosol forming substrate $$\frac{(x+y)}{l},$$

ranges from about 0.5 to about 0.8.

The inventors have found that this range of the ratio $$\frac{(x+y)}{l}$$

substantially increases or maximizes the advantages of the smoking experience. This ratio has the advantage that it substantially increases or maximizes the aerosol delivery amount, while substantially reducing or minimizing the amount of aerosol escaping from the upstream portion of the aerosol forming substrate. This substantially reduces or minimizes the occurrence of condensation of the aerosol within the smoking system. Further, this ratio also has the advantage that it substantially reduces or minimizes heat loss through non-tobacco materials. This means that the smoking system requires less energy. A ratio of about 0.7 (for a tobacco plug of either 10 mm or 12 mm) offers the best balance in terms of aerosol deliveries, minimizing the occurrence of aerosol leaving the upstream end of the aerosol forming substrate and aerosol temperature.

In the preferred embodiment, each heating element may be in the form of a ring extending substantially partially or fully around the circumference of the aerosol forming substrate. Preferably, the position of each heating element is fixed with respect to the electrically heated smoking system and hence the aerosol forming substrate. Preferably, the heater does not include an end portion to heat the upstream end of the aerosol forming substrate. This provides a non-heated portion of aerosol forming substrate at the upstream end.

Each heating element preferably includes an electrically resistive material. Each heating element may include a non-elastic material, for example a ceramic sintered material, such as alumina ($Al_2O_3$) and silicon nitride ($Si_3N_4$), or printed circuit board or silicon rubber. Alternatively, each heating element may include an elastic, metallic material, for example an iron alloy or a nickel-chromium alloy.

Other suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may include doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminium-titanium-zirconium-, hafnium-, niobium-, molybdenum-, tantalum-, tungsten-, tin-, gallium- and manganese-alloys, and super-alloys based on nickel, iron, cobalt, stainless steel, Timetal® and iron-manganese-aluminium based alloys. Timetal® is a registered trade mark of Titanium Metals Corporation, 1999 Broadway Suite 4300, Denver, Colo. In composite materials, the electrically resistive material may optionally be embedded in, encapsulated or coated with an insulating material or vice-versa, depending on the kinetics of energy transfer and the external physico-chemical properties required.

Alternatively, each heating element may include an infrared heating element, a photonic source, or an inductive heating element.

In the preferred embodiment, each heating element may include a heat sink, or heat reservoir including a material capable of absorbing and storing heat and subsequently releasing the heat over time to the aerosol forming substrate. The heat sink may be formed of any suitable material, such as a suitable metal or ceramic material. Preferably, the material has a high heat capacity (sensible heat storage material), or is a material capable of absorbing and subsequently releasing heat via a reversible process, such as a high temperature phase change. Suitable sensible heat storage materials include silica gel, alumina, carbon, glass mat, glass fiber, minerals, a metal or alloy such as aluminium, silver or lead, and a cellulose material such as paper. Other suitable materials which release heat via a reversible phase change include paraffin, sodium acetate, naphthalene, wax, polyethylene oxide, a metal, metal salt, a mixture of eutectic salts or an alloy.

Preferably, the aerosol forming substrate includes a tobacco-containing material containing volatile tobacco flavor compounds which are released from the substrate upon heating. Alternatively, the aerosol forming substrate may include a non-tobacco material.

Preferably, the aerosol forming substrate further includes an aerosol former. Examples of suitable aerosol formers are glycerine and propylene glycol.

In one embodiment, the aerosol forming substrate is a solid or substantially solid substrate. The solid substrate may include, for example, one or more of: powder, granules, pellets, shreds, spaghettis, strips or sheets containing one or more of: herb leaf, tobacco leaf, fragments of tobacco ribs, reconstituted tobacco, homogenized tobacco, extruded tobacco and expanded tobacco. The solid substrate may be provided as a cylindrical plug of aerosol forming substrate. Alternatively, the solid substrate may be provided in a suitable container or cartridge. Optionally, the solid substrate may contain additional tobacco or non-tobacco volatile flavor compounds, to be released upon heating of the substrate.

Optionally, the solid substrate may be provided on or embedded in a thermally stable carrier. The carrier may take the form of powder, granules, pellets, shreds, spaghettis, strips or sheets. Alternatively, the carrier may be a tubular carrier having a thin layer of the solid substrate deposited on its outer surface, or on both its inner and outer surfaces. Such a tubular carrier may be formed of, for example, a paper, or paper like material, a non-woven carbon fiber mat, a low mass open mesh metallic screen, or a perforated metallic foil or any other thermally stable polymer matrix. The solid substrate may be deposited on the surface of the carrier in the form of, for example, a sheet, foam, gel or slurry. The solid substrate may be deposited on the entire surface of the carrier, or alternatively, may be deposited in a pattern in order to provide a non-uniform flavor delivery during use.

Alternatively, the carrier may be a non-woven fabric or fiber bundle into which tobacco components have been incorporated. The non-woven fabric or fiber bundle may include, for example, carbon fibers, natural cellulose fibers, or cellulose derivative fibers.

Alternatively, the aerosol forming substrate may be a liquid substrate. If a liquid substrate is provided, the electrically heated smoking system preferably includes means for retaining the liquid. For example, the liquid substrate may be retained in a container. Alternatively or in addition, the liquid substrate may be absorbed into a porous carrier material. The porous carrier material may be made from any suitable absorbent plug or body, for example, a foamed metal or plastics material, polypropylene, terylene, nylon fibers or ceramic. The liquid substrate may be retained in the porous carrier material prior to use of the electrically heated smoking system or alternatively, the liquid substrate material may be released into the porous carrier material during, or immediately prior to use. For example, the liquid substrate may be provided in a capsule. The shell of the capsule preferably melts upon heating and releases the liquid substrate into the porous carrier material. The capsule may optionally contain a solid aerosol forming substrate in combination with the liquid.

Alternatively, or in addition, if the aerosol forming substrate is a liquid substrate, the electrically heated smoking system may further include an atomizer in contact with the liquid substrate source and including the heating element or elements. Preferably, the atomizer converts the liquid into an aerosol or fine mist of particles. Also preferably, the atomizer may include a liquid source connected to a tube. Moreover, the tube may be heated by an electrical heater in close proximity to the tube, or in contact with the tube. The liquid is atomized when the tube is heated by the heater when electrical energy is passed through the heater.

In addition to the heating element or elements, the atomizer may include one or more electromechanical elements such as piezoelectric elements. Additionally or alternatively, the atomizer may also include elements that use electrostatic, electromagnetic or pneumatic effects. The electrically heated smoking system may still further include a condensation chamber.

Alternatively, the aerosol forming substrate may be any other sort of substrate, for example, a gas substrate, or any combination of the various types of substrate. During operation, the substrate may be completely contained within the electrically heated smoking system. In that case, a smoker may puff on a mouthpiece of the electrically heated smoking system. Alternatively, during operation, the substrate may be partially contained within the electrically heated smoking system. In that case, the substrate may form part of a separate smoking article and the smoker may puff directly on the smoking article.

Preferably, the electrically heated smoking system further includes a power supply for supplying power to the heating element or elements. The power supply may be any suitable power supply, for example a DC voltage source. In one embodiment, the power supply is a lithium-ion battery. Alternatively, the power supply may be a Nickel-metal hydride battery or a nickel cadmium battery.

Preferably, the electrically heated smoking system further includes electronic circuitry arranged to be connected to the power supply and the heating element or elements. If more than one heating element is provided, preferably the electronic circuitry provides for the heating elements to be independently controllable. The electronic circuitry may be programmable.

In the preferred embodiment, the system further includes a sensor to detect air flow indicative of a smoker taking a puff. The sensor may be an electro-mechanical device. Alternatively, the sensor may be any of: a mechanical device, an optical device, an opto-mechanical device and a micro electro mechanical systems (MEMS) based sensor. Preferably, the sensor is connected to the power supply and the system is arranged to activate the heating element or elements when the sensor senses a smoker taking a puff. In an alternative embodiment, the system further includes a manually operable switch, for a smoker to initiate a puff.

Preferably, the system further includes a housing for receiving the aerosol forming substrate, which is designed to be grasped by a smoker.

It should be noted that features described in relation to one aspect of the invention may also be applicable to another aspect of the invention.

FIG. 1 shows a smoking article 101 received in an electrically heated smoking system 103 according to a first embodiment. In this embodiment, the smoking article 101 has an elongate cylindrical shape and includes an aerosol forming substrate 105, and a filter plug 107, arranged sequentially and in coaxial alignment. The components 105 and 107 are overwrapped with an outer paper wrapper 109. In this embodiment, the aerosol forming substrate 105 is in the form of a cylindrical plug of solid substrate. The length l of the plug is substantially parallel to the length of the smoking article and also substantially parallel to the direction of airflow (not shown) in the electrically heated smoking system when a smoker puffs on the smoking article. The circumference of the plug is substantially perpendicular to the length. The filter plug 107 is located at the downstream end of the smoking article 101 and, in this embodiment, is separated from the aerosol forming substrate 105 by separation 111.

As already discussed, various types of smoking article may be used in the electrically heated smoking system. Thus, the smoking article does not need to be of the form illustrated in FIG. 1. In particular, the smoking article does not have to have a length of aerosol forming substrate which is substantially perpendicular to its circumference.

As illustrated in FIG. 1, the electrically heated smoking system 103 includes a heater having a heating element 113. The heating element is resistive, and heats up as electrical current is passed through the heating element. In this embodiment, the heating element 113 is in the form of a ring, having a width w and a diameter h.

In FIG. 1, the upstream end of the smoking article 101 is labelled 115, while the downstream end of the smoking article is labelled 117. Further, the upstream end of the aerosol forming substrate is labelled 119, while the downstream end of the aerosol forming substrate is labelled 121. Finally, the upstream end of the heating element is labelled 123, while the downstream end of the heating element is labelled 125.

In an alternative embodiment, the heater may be an internal heater. An internal heater is one which is placed within the aerosol forming substrate, for example as described in our co-pending European Patent Application No. 09252501.3, filed 29 Oct. 2009, the contents of which are hereby incorporated by reference in their entirety. The internal heater may be manufactured as described below with reference to FIGS. 6 to 11.

In an alternative embodiment the heater may include a temperature sensor used as an internal heater which is placed inside the aerosol forming substrate. An example of a suitable internal heater is a PT resistive temperature sensor which may be used as an internal heater. The PT resistive temperature sensor may be made by Heraeus Sensor Technology, Reinhard-Heraeus-Ring, 23D-63801, Kleinostheim, Germany.

In the case of both internal and external heaters the heating element 113 extends only partially along the length l of the cylindrical plug of aerosol forming substrate 105. That is to say, the width w of the heating element 113 is less than the length l of the plug of aerosol forming substrate 105. The heating element 113 is positioned towards the downstream end 121 of the aerosol forming substrate 105.

In the embodiment illustrated in FIG. 1, the downstream end 125 of the heating element 113 is upstream of the downstream end 121 of the cylindrical plug of aerosol forming substrate 105. In this embodiment, the separation between the downstream end 125 of the heating element 113 and the downstream end 121 of the cylindrical plug of aerosol forming substrate 105 is d. Also in this embodiment, the upstream end 123 of the heating element 113 is downstream of the upstream end 119 of the cylindrical plug of aerosol forming substrate 105. Preferably, the separation between the upstream end 123 of the heating element 113 and the upstream end 119 of the cylindrical plug of aerosol forming substrate 105 is e.

Various dimensions of the heating element 113 and the plug of aerosol forming substrate 105, as well as the relative positions of the heating element 113 and the plug of aerosol forming substrate 105, can be adjusted to substantially improve the smoking experience. In particular, the time to first puff can be reduced. That is to say, the time between the heating element being activated and the smoker being able to take a first puff on the smoking article can be reduced. In addition, the power required to generate the aerosol and sustain that aerosol generation can be reduced. In addition, this substantially reduces or minimizes the occurrence of aerosol leaving the upstream portion of the aerosol forming substrate. Furthermore, condensate and other residues forming on the inside of the electrically heated smoking system can be substantially reduced or minimized, so as to reduce cleaning required.

As already mentioned, the heating element 113 is positioned towards the downstream end of the aerosol forming substrate 105. That is to say, d<e. For an aerosol forming substrate containing tobacco, positioning the heating element 113 towards the downstream end of the aerosol forming substrate 105 shortens the tobacco filtration zone contained between the downstream end of the heating element 113 and the downstream end of the plug of aerosol forming substrate 105 (that is to say, reduces d). This leads to a significant reduction of the energy required to generate a pleasant smoke and similarly leads to a reduction of the time to first puff. However, it is preferable for d not to be reduced to zero, as previously described. In fact, it has been found that, in order to substantially increase or maximize the advantages of the smoking experience, the separation between the downstream end of the heating element 113 and the downstream end of the cylindrical plug of aerosol forming substrate 105, d, should be greater than or equal to 1 mm.

In addition, it has been found that, in order to substantially increase or maximize the advantages of the smoking experience, the separation between the upstream end 123 of the heating element 113 and the upstream end 119 of the (preferably) cylindrical plug of aerosol forming substrate 105, e, should range from about 2 mm to about 6 mm and, more preferably, 4 mm. This non-heated portion of the cylindrical plug located at the upstream end provides an efficient filtration zone to substantially reduce or minimize the occurrence of aerosol leaving the upstream end of the aerosol forming substrate of the smoking article. Consequently, this substantially reduces or minimizes the occurrence of condensation of aerosol, such as tobacco smoke, inside the internal walls of the electrically heated smoking system 103, which substantially reduces or minimizes the number of cleaning operations required throughout the lifetime of the electrically heated smoking system. Moreover, the non-heated zone acts as a slow-release smoking material reservoir which may be accessible by thermal conduction inside the plug during the smoking experience.

In addition, it has been found that, in order to substantially increase or maximize the advantages of the smoking experience, the width w of the heating element 113 in relation to the length l of the plug of aerosol forming substrate 105, as well as the positioning of the heating element 113 in relation to the plug of aerosol forming substrate 105 can be adjusted. In particular, it has been found that the ratio of the width of the heating element to the length of the plug of aerosol forming substrate, $$\frac{w}{l}$$

should be range from about 0.35 to about 0.6, more preferably, 0.5. The ratio $$\frac{w}{l}$$

as well as w itself, may be adjusted to appropriately deliver the aerosol up to a desired number of puffs.

Figure 2:
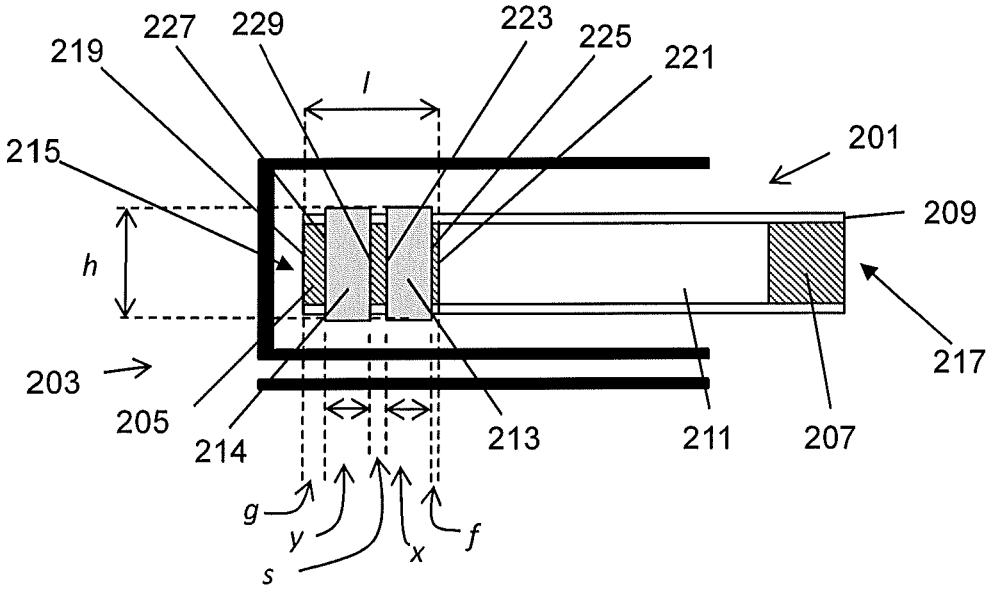
FIG. 2 is a schematic diagram showing a second embodiment of the electrically heated smoking system in smoking with a smoking article.

FIG. 2 shows a smoking article 201 received in an electrically heated smoking system 203 according to a second embodiment. In this embodiment, just like in FIG. 1, the smoking article 201 has an elongate cylindrical shape and includes an aerosol forming substrate 205, and a filter plug 207, arranged sequentially and in coaxial alignment. The components 205 and 207 are overwrapped with an outer paper wrapper 209. In this embodiment, the aerosol forming substrate 205 is in the form of a cylindrical plug of solid substrate. The length l of the plug may be substantially parallel to the length of the smoking article and also substantially parallel to the direction of airflow (not shown) in the electrically heated smoking system when a smoker puffs on the smoking article. The circumference of the plug may be substantially perpendicular to the length. The filter plug 207 is located at the downstream end of the smoking article 201 and, in this embodiment, is separated from the aerosol forming substrate 205 by separation 211.

As already discussed, various types of smoking article may be used in the context of the present invention. The smoking article does not need to be of the form illustrated in FIG. 2. For example, the smoking article doe not necessarily have to have a length of aerosol forming substrate substantially perpendicular to its circumference.

In the second embodiment illustrated in FIG. 2, the electrically heated smoking system 203 includes a heater having a first heating element 213 and a second heating element 214 upstream of the first heating element. In this embodiment, the heating elements 213, 214 are both in the form of rings. That is to say that the heaters are external heating elements. The heating elements are resistive, and heat up as electrical current is passed through the heating element.

In FIG. 2, the upstream end of the smoking article 201 is labelled 215, while the downstream end of the smoking article is labelled 217. Further, the upstream end of the aerosol forming substrate is labelled 219, while the downstream end of the aerosol forming substrate is labelled 221. Further, the upstream end of the first heating element 213 is labelled 223, while the downstream end of the first heating element 213 is labelled 225. Finally, the upstream end of the second heating element 214 is labelled 227, while the downstream end of the second heating element 214 is labelled 229.

In an alternative embodiment, one or more of the heaters may be an internal heater. An internal heater is one which is placed within the aerosol forming substrate, for example as described in our co-pending European Patent Application No. 09252501.3, filed 29 Oct. 2009, the contents of which are hereby incorporated by reference in their entirety. The internal heater may be manufactured as described below with reference to FIGS. 6 to 11.

In an alternative embodiment, the heater may include a temperature sensor used as an internal heater which is placed inside the aerosol forming substrate. An example of a suitable internal heater is a PT resistive temperature sensor used as an internal heater. The PT resistive temperature sensor may be made by Heraeus Sensor Technology, Reinhard-Heraeus-Ring, 23D-63801, Kleinostheim, Germany.

Two such heaters may be placed adjacent each other and clamped or held in position on a holder to form the first heating element 213 and the second heating element 214 upstream of the first heating element.

For both internal and external heaters, the width of the first heating element 213 is x and the width of the second heating element 214 is y. In this embodiment, both heating elements 213, 214 have the same diameter h although the diameters need not be equal. Both heating elements 213, 214 may extend substantially around the circumference of the cylindrical plug of aerosol forming substrate 205. Alternatively, one or more of the heating elements may be an internal heater inserted inside the aerosol forming substrate as previously described. However, each heating element extends only partially along the length l of the cylindrical plug of aerosol forming substrate 205. That is to say, the width x of the first heating element 213 is less than the length l of the plug of aerosol forming substrate 205 and the width y of the second heating element 214 is also less than the length l of the plug of aerosol forming substrate 205. In addition, both heating elements together extend only partially along the length of the cylindrical plug of aerosol forming substrate 205. That is to say, (x+y) is less than the length l of the plug of aerosol forming substrate 205. Preferably, the first heating element 213 is positioned towards the downstream end 221 of the aerosol forming substrate 205, and the second heating element 214 is positioned upstream of the first heating element 213 and separated from the first heating element by a distance s. In other words, the upstream end 223 of the first heating element 213 is separated from the downstream end 229 of the second element 214 by a distance s.

In this embodiment, the downstream end 225 of the first heating element 213 is upstream of the downstream end 221 of the plug of aerosol forming substrate 205. Preferably, the separation between the downstream end 225 of the first heating element 213 and the downstream end 221 of the cylindrical plug of aerosol forming substrate 205 is f. Also preferably, the upstream end 227 of the second heating element 214 is downstream of the upstream end 219 of the cylindrical plug of aerosol forming substrate 205. Moreover, the separation between the upstream end 227 of the second heating element 214 and the upstream end 219 of the cylindrical plug of aerosol forming substrate 205 is g. As already mentioned, the separation between the heating elements 213 and 214 is s.

Various dimensions of the heating elements 213, 214 and the plug of aerosol forming substrate 205, as well as the relative positions of the heating elements 213, 214 and the plug of aerosol forming substrate 205 can be adjusted to substantially improve the smoking experience. In particular, the time to first puff can be reduced. That is to say, the time between the heating element or elements being activated and the smoker being able to take a first puff on the smoking article can be reduced. In addition, the power required to generate the aerosol and sustain that aerosol generation can be reduced. In addition, this substantially reduces or minimizes the occurrence of aerosol escaping from the upstream portion of the aerosol forming substrate. Furthermore, the occurrence of condensate and other residues forming on the inside of the electrically heated smoking system can be substantially reduced or minimized, which can reduce cleaning required.

As already mentioned, the heating elements 213, 214 are positioned towards the downstream end of the aerosol forming substrate 205. That is to say, f<g. For an aerosol forming substrate containing tobacco, positioning the heating elements 213, 214 towards the downstream end of the aerosol forming substrate 205 shortens the tobacco filtration zone contained between the downstream end of the first heating element 213 and the downstream end of the plug of aerosol forming substrate 205 (that is to say, reduces f). This leads to a significant reduction of the energy required to generate a pleasant smoke and similarly leads to a reduction of the time to first puff. However, it is preferable for f not to be reduced to zero, as previously described. In fact, it has been found that, in order to substantially increase or maximize the advantages of the smoking experience, the separation between the downstream end of the first heating element 213 and the downstream end of the cylindrical plug of aerosol forming substrate 205, f, should be greater than or equal to 1 mm.

In addition, it has been found that, in order to substantially increase or maximize the advantages of the smoking experience, the separation between the upstream end 227 of the second heating element 214 and the upstream end 219 of the (preferably) cylindrical plug of aerosol forming substrate 205, g, should range from about 2 mm to about 4 mm and, more preferably, about 3 mm. This non-heated portion of the cylindrical plug located at the upstream end 219 of the aerosol forming substrate provides an efficient filtration zone to substantially reduce or minimize the occurrence of aerosol escaping from the upstream portion of the aerosol forming substrate. Consequently, this substantially reduces or minimizes the occurrence of condensation of aerosol, for example tobacco smoke, inside the internal walls of the electrically heated smoking system 203. This substantially reduces or minimizes the number of cleaning operations required throughout the lifetime of the electrically heated smoking system. Moreover, the non-heated zone acts as a slow-release smoking material reservoir which may be accessible during the smoking experience by thermal conduction inside the aerosol forming substrate.

In order to substantially increase or maximize g, so as to provide an efficient filtration zone and, at the same time, substantially reduce or minimize f, so as to reduce the power requirements, the separation s of the heating elements 213, 214 should be substantially reduced or minimized. However, it has been found that s should not be reduced to zero, as previously described. In fact, it has been found that, in order to substantially increase or maximize the advantages of the smoking experience, the separation s between the upstream end 223 of the first heating element 213 and the downstream end 229 of the second heating element 214 should be greater than or equal to about 0.5 mm.

In addition, it has been found that, in order to substantially increase or maximize the advantages of the smoking experience, the combined width (x+y) of the heating elements 213, 214 in relation to the length l of the plug of aerosol forming substrate 205, as well as the positioning of the heating elements 213, 214 in relation to the plug of aerosol forming substrate 205 can be adjusted. In particular, it has been found that the ratio of the combined width of the heating elements to the length of the plug of aerosol forming substrate, $$\frac{(x+y)}{l}$$

should range from about 0.5 to about 0.8. The ratio $$\frac{(x+y)}{l}$$

as well as x and y, may be adjusted to appropriately deliver the aerosol up to a desired number of puffs.

Figure 3:
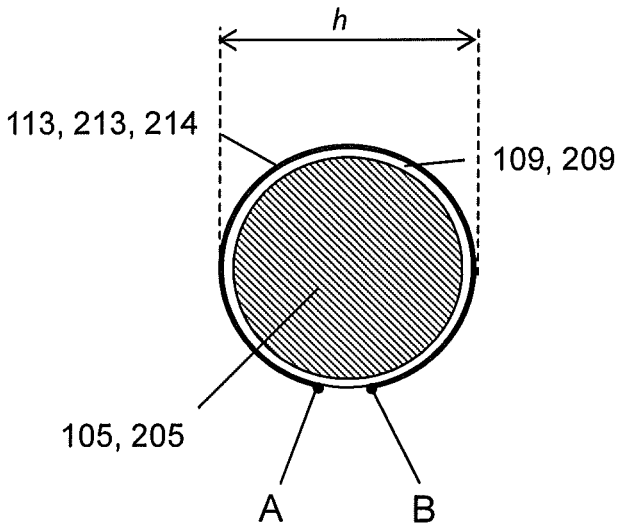
FIG. 3 is a detailed view of a cross-section of an external heating element according to one embodiment of the invention, which may be used in conjunction with FIG. 1 or FIG. 2.
Figure 4:
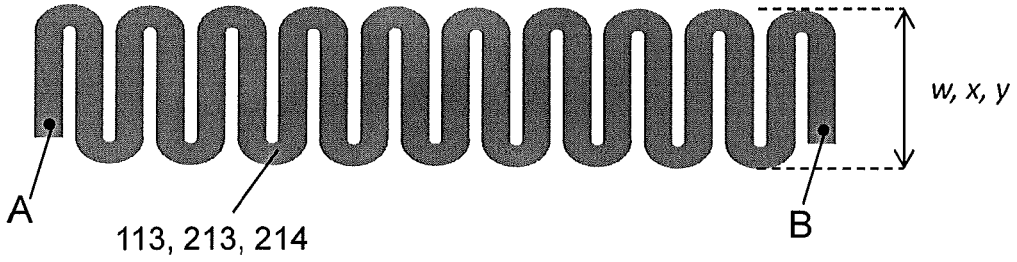
FIG. 4 is a detailed view of an external heating element laid out flat according to one embodiment of the invention, which may be used in conjunction with FIG. 1 or FIG. 2.
Figure 5:
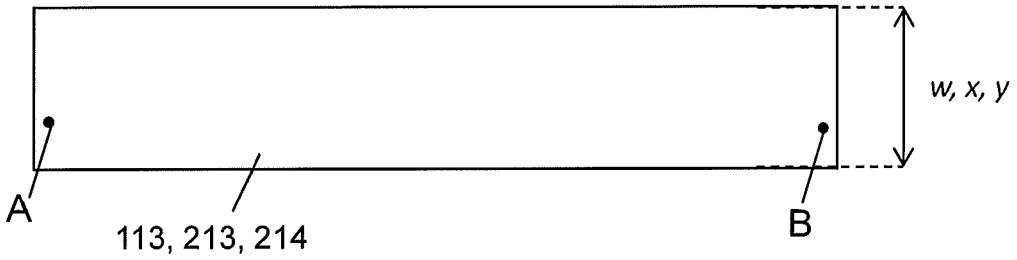
FIG. 5 is a detailed view of an external heating element laid out flat according to another embodiment of the invention, which may be used in conjunction with FIG. 1 or FIG. 2.

FIG. 3 is a detailed view of a cross-section of an external heating element. FIG. 4 is a detailed view of an external heating element laid out flat, and FIG. 5 is a detailed view of an external heating element laid out flat according to another embodiment. The external heating elements of FIGS. 3, 4 and 5 may be used in conjunction with the embodiments of either FIG. 1 or FIG. 2. Note that, for the sake of clarity, FIGS. 1, 2, 3, 4 and 5 are not to the same scale.

FIG. 3 is an enlarged section through the external heating element 113, 213, 214. As shown in FIG. 3, the heating element 113, 213, 214 may take the form of an incomplete ring, having a diameter h. An electrical connection to a voltage V+ is made at A, and an electrical connection to a voltage V− is made at B. The ring is incomplete because a gap or separation may be formed in the ring to provide the electrical connections A and B. In FIG. 3, the gap between the two terminals A and B has been exaggerated for the sake of clarity. However, the gap or spacing between the two terminals is preferably as small as possible, while not permitting an electrical short circuit between the two terminals. The gap between the two terminals may be about 0.5 mm or about 1 mm.

In FIG. 3, an aerosol forming substrate 105, 205 is located inside or within the external heating element 113, 213, 214. In FIG. 3, the aerosol forming substrate 105, 205 is surrounded by an optional paper wrapper 109, 209. In the case in which the aerosol forming substrate is surrounded by an outer paper wrapper, the heating element may be in physical contact with the outer paper wrapper to allow for efficient transfer of heat to the aerosol forming substrate via the paper wrapper. In the case in which there is no paper wrapper, the heating element 113, 213, 214 may be in physical contact with aerosol forming substrate to directly transfer heat to the aerosol forming substrate.

FIG. 4 shows the heating element in which the ring is unwrapped or laid out flat to show the detailed structure of the heating element 113, 213, 214. The heating element 113, 213, 214 may include one or more substantially u-shaped segments, each u-shaped segment having two substantially straight portions electrically connected to each other by a semi-circular portion. One or more of the U-shaped elements are joined together at the end of the one of the straight portions of the U-shaped elements to form the structure shown in FIG. 4. The straight portions may be substantially parallel to one another. In use, the straight portions may be positioned so that they are substantially parallel to the longitudinal axis of the smoking article. The heating element 113, 213, 214 may extend substantially fully around the circumference of the aerosol forming substrate. The heating element 113, 213, 214 may be stamped out from suitable sheet material and then formed into the ring shape as shown in FIG. 3.

FIG. 5 shows another embodiment of the heating element 113, 213, 214 in which the ring is unwrapped or laid out flat to show the detailed structure of the heating element 113, 213, 214. The heating element 113, 213, 214 shown in FIG. 5 includes a rectangle of sheet material. The heating element 113, 213, 214 may be stamped out from suitable sheet material and then formed into the ring shape as shown in FIG. 3, by shaping or bending.

Other shapes of the heating element 113, 213, 214 are possible such as one or more semi-circular rings, each ring electrically joined to its neighbour such that when it is laid out flat, the semicircular rings form an elongated structure that extends in a particular direction. The rings are arranged so that they form troughs and peaks in a rippled or wavy structure. As before, the heating element 113, 213, 214 may be flat stamped out of a piece of suitable material using a suitably shaped stamp. The heating element 113, 213, 214 may then be bent into the appropriate shape, as shown in FIG. 3. The heating element 113, 213, 214 may also be mechanically attached to the rest of the smoking system, to prevent relative movement of the housing and the heater.

Preferably, control circuitry is provided which controls when the voltages are applied to A and B. When a potential difference is applied between A and B, electrical current flows along the heating element from A to B or from B to A, and the heating element heats up as a result of the Joule heating effect which occurs in the heating element. In an alternative embodiment, the heating element does not have to include one or more u-shaped elements, but may be substantially annular in shape with a portion of the annulus removed to allow electrical connection of a potential difference.

The provision of two heating elements in the embodiment of FIG. 2 allows the smoker to stop and resume the smoking experience without needing to reheat any portion of the substrate. One possible method of usage is as follows. Firstly, the first (downstream) heating element 213 is activated at the start of the smoking experience. Then, the heating element 213 is deactivated at one of the following events: 1) the puff count of the first heating element 213 reaches a predetermined limit, 2) the smoker terminates the smoking experience, or 3) the smoking article 201 is removed from the electrically heated smoking system 203. Then, the second (upstream) heating element 214 may be activated at one of the following events: 1) the smoker wishes to resume the smoking experience after a short or extended break, or 2) the puff count of the first heating element 213 has reached a predetermined limit so the second heating element 214 needs to be activated in order to begin heating a new portion of the substrate.

This method allows a fresh portion of the substrate to be heated for each heating sequence. Optionally, one or more additional heating elements may also be provided between the downstream heating element and the upstream heating element.

The heating elements shown in FIGS. 1, 2, 3, 4 and 5 may be made from any suitable material, for example an electrically resistive material. Preferred materials include a ceramic sintered material, such as alumina ($Al_2O_3$) and silicon nitride ($Si_3N_4$), printed circuit board, silicon rubber, an iron alloy or a nickel-chromium alloy.

The aerosol forming substrates shown in FIGS. 1, 2, 3, 4 and 5 may be provided in any suitable form. In the illustrated embodiments, the substrate is a solid substrate in the shape of a cylindrical plug which forms part of a smoking article. The substrate may alternatively be a separate substrate which may be directly inserted into the electrically heated smoking system.

FIGS. 6 to 11 show a manufacturing process for the internal heater using a technique similar to that used in screen printing.

Figure 6:
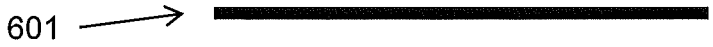
FIGS. 6 to 11 illustrate sequential steps in a method for forming an internal heater according to one embodiment of the invention.

Referring to FIG. 6, firstly an electrically insulating substrate 601 is provided. The electrically insulating substrate may include any suitable electrically insulating material, for example, but not limited to, a ceramic such as MICA, glass or paper. Alternatively, the electrically insulating substrate may include an electrical conductor that is insulated from the electrically conductive tracks (produced in FIG. 7 and discussed below), for example, by oxidizing or anodizing its surface or both. One example is anodized aluminium. Alternatively, the electrically insulating substrate may include an electrical conductor to which is added an intermediate coating called a glaze. In that case, the glaze has two functions: to electrically insulate the substrate from the electrically conductive tracks, and to reduce bending of the substrate. Folds existing in the electrically insulating substrate can lead to cracks in the electrically conductive paste (applied in FIG. 7 and discussed below) causing defective resistors.

Figure 7:
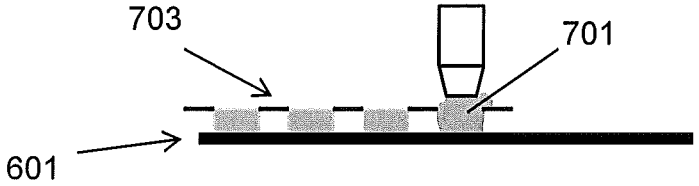

Referring to FIG. 7, the electrically insulating substrate is held securely, such as by a vacuum, while a metal paste 701 is coated onto the electrically insulating substrate using a cut out 703. Any suitable metal paste may be used but, in one example, the metal paste is silver paste. In the preferred embodiment, the paste includes about 20% to about 30% of binders and plasticizers and about 70% to about 80% of metal particles, typically silver particles. The cut out 703 provides a template for the desired electrically conductive tracks. After the metal paste 701 has been coated onto the electrically insulating substrate 601, the electrically insulating substrate and paste are fired, for example, in a sintering furnace. In a first firing phase ranging from about 200° C. to about 400° C., the organic binders and solvents are burned out. In a second firing phase ranging from about 350° C. to about 500° C. the metal particles are sintered.

Figure 8:
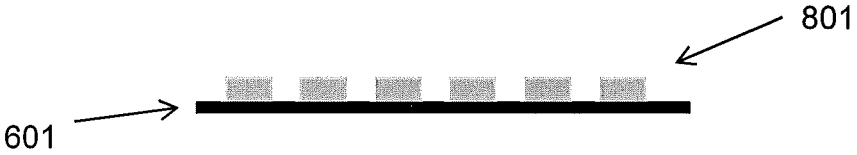

Referring to FIG. 8, the result is an electrically insulating substrate 601 having an electrically conductive track or tracks 801 thereon. The electrically conductive track or tracks includes heating resistors and the necessary connection pads. Finally, the electrically insulating substrate 601 and electrically conductive tracks 801 are formed into the appropriate form for use as a heater in an electrically heated smoking system.

Figure 9:
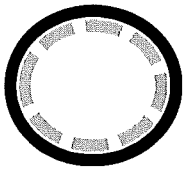

Referring to FIG. 9, the electrically insulating substrate 601 may be rolled into tubular form, such that the electrically conductive tracks lie on the inside of the electrically insulating substrate. In that case, the tube may function as an external heater for a solid plug of aerosol forming material. The internal diameter of the tube may be the same as or slightly bigger than the diameter of the aerosol forming plug.

Figure 10:
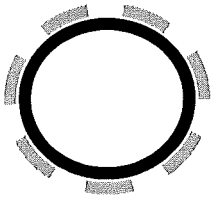

Referring to FIG. 10, alternatively, the electrically insulating substrate 601 may be rolled into tubular form, such that the electrically conductive tracks lie on the outside of the electrically insulating substrate. In that case, the tube may function as an internal heater and can be inserted directly into the aerosol forming substrate. This may work well when the aerosol forming substrate takes the form of a tube of tobacco material, for example, such as tobacco mat such as that described in U.S. Pat. No. 5,499,636 to Baggett, Jr. et al., which is incorporated herein by reference in its entirety, or other form of reconstituted tobacco. In that case, the external diameter of the tube may be the same as or slightly smaller than the internal diameter of the aerosol forming substrate tube.

Figure 11:
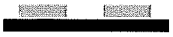

Referring to FIG. 11, alternatively, if the electrically insulating substrate 601 is sufficiently rigid or is reinforced in some way, some or all of the electrically insulating substrate and electrically conductive tracks may be used directly as an internal heater simply by inserting the electrically insulating substrate and electrically conductive tracks directly into the aerosol forming substrate.

In this specification, the word "about" is often used in connection with numerical values to indicate that mathematical precision of such values is not intended. Accordingly, it is intended that where "about" is used with a numerical value, a tolerance of ±10% is contemplated for that numerical value.

In this specification the words "generally" and "substantially" are sometimes used with respect to terms. When used with geometric terms, the words "generally" and "substantially" are intended to encompass not only features which meet the strict definitions but also features which fairly approximate the strict definitions.

While the foregoing describes in detail a preferred electrically heated smoking system and methods of making with reference to a specific embodiment thereof, it will be apparent to one skilled in the art that various changes and modifications may be made to the electrically heated smoking system and equivalents method may be employed, which do not materially depart from the spirit and scope of the invention. Accordingly, all such changes, modifications, and equivalents that fall within the spirit and scope of the invention as defined by the appended claims are intended to be encompassed thereby.

We claim:

1. An electrically heated system comprising:

a smoking article including an aerosol-forming substrate, the aerosol-forming substrate including tobacco; and a housing including a heater in the tobacco to heat the tobacco at a non-combustible temperature, the heater and smoking article being configured such that the heater extends a distance only partially within the smoking article, a ratio of a width of the heater to a length of the aerosol-forming substrate is in a range from 0.35 to 0.6, the width of the heater and the length of the aerosol-forming substrate being in a longitudinal direction of the smoking article.

2. The electrically heated system of claim 1, wherein the heater is electrically resistive.

3. The electrically heated system of claim 1, wherein the aerosol-forming substrate is a solid substrate.

4. The electrically heated system of claim 3, wherein the smoking article includes a filter, the filter being separated from the tobacco by at least 5 mm.

5. The electrically heated system of claim 4, wherein the filter is separated from the tobacco by at least 20 mm.

6. The electrically heated system of claim 5, wherein the filter is 5 mm-10 mm in length.

7. The electrically heated system of claim 6, wherein the length of the aerosol-forming substrate is 10-12 mm.

8. The electrically heated system of claim 7, wherein a length of the smoking article is 30 mm-100 mm.

9. The electrically heated system of claim 8, wherein the length of the smoking article is about 45 mm.

10. The electrically heated system of claim 9, wherein the electrically heated system is configured to heat the heater from about 250 degrees Celsius to about 440 degrees Celsius.

* * * * *